US006524354B2

(12) United States Patent
Sinha et al.

(10) Patent No.: US 6,524,354 B2
(45) Date of Patent: Feb. 25, 2003

(54) PROCESS FOR THE PRODUCTION OF LOW ASH FUEL

(75) Inventors: Paras Nath Sinha, Bihar (IN); Partha Sengupta, Bihar (IN); Kali Sankar Bhattacharya, Bihar (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 09/822,760

(22) Filed: Mar. 30, 2001

(65) Prior Publication Data

US 2002/0178651 A1 Dec. 5, 2002

(51) Int. Cl.[7] ..... C10L 5/06

(52) U.S. Cl. ..... 44/564; 44/568; 44/569; 44/594; 44/595; 44/596; 44/597; 44/598; 44/591; 44/607

(58) Field of Search ..... 44/564, 568, 569, 44/594, 595, 596, 597, 598, 591, 607

(56) References Cited

U.S. PATENT DOCUMENTS 3,403,989 A 10/1968 Blake et al.

4,093,425 A * 6/1978 Araki ..... 44/595

FOREIGN PATENT DOCUMENTS

| | | |
|---|---|---|
| EP | 1063277 | * 12/2000 |
| GB | 761153 | 11/1956 |
| GB | 1028114 | 5/1966 |
| JP | 57005790 | 1/1982 |

OTHER PUBLICATIONS

Patents Abstracts of Japan Publication No. 57005790 Dated Jan. 12, 1982.

* cited by examiner

*Primary Examiner*—Cephia D. Toomer
(74) *Attorney, Agent, or Firm*—Ladas & Parry

(57) ABSTRACT

The present invention describes a process for the production of low ash fuel using calcined petroleum coke by crushing and screening of calcined petroleum coke below 3 mm size, mixing the crushed and screened materials to achieve a bulk density in the range of 760 to 800 kg/m3, mixing 10–100% of the resultant calcined petroleum coke with 0 to 50% coke breeze, pre-soaking the mix so obtained with 5–10% water, mixing with hinder followed by kneading in presence of live stream, then briquetting and curing of the raw briquettes in a furnace in a controlled oxidising atmoshpere to obtain the low ash fuel.

5 Claims, No Drawings

PROCESS FOR THE PRODUCTION OF LOW ASH FUEL

FIELD OF THE INVENTION

The present invention relates to a process for the production of low ash fuel using calcined petroleum coke.

The main usage of the invention is to provide a process for the production of low ash, low phosphorus alternative fuel of moulded shape, hard, water resistant having chemical composition such that the product can be safely used in place of by-prpduct/bee-hive coke for industrial and/or metallurgical purposes.

BACKGROUND OF THE INVENTION

Petroleum coke is produced during, refining of crude petroleum oil. After calcination, petroleum coke gives an excellent quality of carbonaceous material having very low ash, low volatile matter, low phosphorus and high fixed carbon content. The calcined petroleum coke has a very limited utility and at present to some extent is used in Electrode industry. It has no use in industrial/metallurgical purposes due to its physical and chemical properties which have made it unsuitable to withstand the burden in the furnace. Most of the oil refineries in the country have a very good stock of calcined petroleum coke. In recent years the demand for low ash metallurgical/industrial coke has increased manifold and the demand is rapidly increasing with the setting up of mini steel plants and foundries for production of high grade steel and casting materials of International Standard.

A process for producing low ash, tailor made fuel will augment the production of briquetted fuel of low ash, low phosphorus content, which can substitute the scarce low ash metallurgical/industrial coke in the low shaft furnaces, cupolas, etc, to produce high grade steel and casting materials Low ash briquetted fuel not only help to produce good quality product but also helps to increase the productivity which is bound to help the industry in a competitive market.

Metallurgical/industrial coke is produced by high temperature carbonisation of coal either in non-recovery type bee-hive ovens or byproduct recovery type coke ovens. For producing low ash, low phosphorus metallurgical/industrial coke, coal of low ash low phosphorus metallurgical/industrial coke, coal of low ash low phosphorus content has to be carbonised. But in India, the availability of low ash, low phosphorus content cooking coal is highly scarce which has compelled the iron and steel industry to import low ash low phosphorus metallurgical coke for production of high grade steel and casting materials. There are processes developed for producing briquette fuel using coal/coke breeze and processed coal tar as binder which can substitute the conventional coke used in metallurgical/industrial purposes. In Indian Patent No. 129108 a process has been described for production of weather resistant, hard, smokeless moulded fuels for industrial/metallurgical uses using coke breeze/char etc. All the processes mentioned above are for producing briquetted fuel which can substitute the conventional industrial/metallurgical coke. But like conventional coke the briquette fuel make from coke breeze is also high ash and moderately high phosphorus content. Such type of product is not suitable for producing high grade low phosphorous iron and steel. Present days, demand of the iron and steel industry is for low ash, low phosphorus metallurgical/industrial coke to produce high grade steel and foundry materials in an economic way to make the product competitive in the market. Prior to the present invention no process was developed and or processed tar for production fuel of low ash, low phosphorus content which can substitute the scarce low ash, low phosphorus content which can substitute the scarce low ash metallurgical/industrial coke. The present invention will eliminate the shortage of availability of low ash, low phosphorus metallurgical coke by briquetted fuel prepared by calcined petroleum coke which is plenty available in the country.

OBJECTS OF THE INVENTION

The main object of the present invention is to provide a process for the production of low ash fuel using calcined petroleum coke which obviates the drawbacks detailed above.

Another object of the present invention is to utilize the briquetted fuel for the production of special grade iron and steel as the content of ash and phosphorous in the product is much below than those present in by-product/bee-hive coke.

Still another object of the present invention is to produce a product of uniform size and shape which permits full utilization of the product and provides better air permeability through the bed.

SUMMARY OF THE INVENTION

A process for producing low ash, tailor made fuel using calcined petroleum coke augments the production of briquetted fuel of low ash, low phosphorus content, which can substitute the scarce low ash metallurgical/industrial coke in the low shaft furnaces, cupolas, etc, to produce high grade steel and casting materials.

Accordingly the present invention provides a process for the production of low ash fuel using calcined petroleum coke which comprises of crushing and screening of the calcined petroleum coke at 3 mm size, mixing the crushed and screened materials to achieve bulk density in the range of 760 to 800 Kg/m$^3$, mixing 10–100% of the resultant calcined petroleum coke with 0 to 50% coke breeze, pre-soaking the mix so obtained with 5–10% water, mixing with binder followed by kneading in presence of live steam then briquetting and curing of the raw briquettes in a furnace in a controlled oxidising atmosphere, through a twin paddle mixer and a screw feeder and curing of the raw briquettes in a furnace where temperature is maintained at the desired level by generating hot fuel gas by combustion of coal in a controlled oxidizing atmosphere, to obtain the low ash fuel.

In one embodiment of the invention, Asphalt or processed low temperature tar is used as binder.

In a further embodiment of the invention, the binder is used in the range of 6 to 7%.

In another embodiment of the invention, the curing of briquettes is effected at a temperature in the range of 250 to 300° C. for a period in the range of 2.5 to 5.5 hours.

DETAILED DESCRIPTION OF THE INVENTION

Low ash fuel is produced according to the process of the invention by using calcined petroleum coke. Calcined petroleum coke is crushed and screened at 3 mm size, and then mixed to achieve bulk density in the range of 760 to 800 Kg/m3. Of the resultant calcined petroleum coke, 10–100% is mixed with with 0 to 50% coke breeze, the mix so obtained being pre-soaked with 5–10% water. The pre-soaked mix is then mixed with a binder followed by kneading in presence of live steam. Briquetting and curing of the raw briquettes in a furnace in a controlled oxidising atmosphere, through a twin paddle mixer and a screw feeder. Curing of the raw briquettes is done in a furnace where temperature is maintained at the desired level by generating hot fuel gas by combustion of coal in a controlled oxidizing atmosphere, to obtain the low ash fuel.

The product, comprising of low phosphorus alternate fuel of moulded shape, hard, water resistant, can be safely used in place of by-product/bee-hive coke for industrial and/or metallurgical purposes, The product can be suitably and sized as per requirements of the Ferro-chrome, Ferro-Silicon, Ferro-manganese and allied industries. Binders like Asphalt of 80/100 grade, and processed low temperature tar are used which are readily available in the market and thus minimizes the cost towards the preparation of binder.

The process does not require any carbonization step to make the product smokeless, hard and water resistant which makes the process comparatively less energy incentive.

(a) The calcined petroleum coke obtained from oil refinery is screened at 3 mm. The plus 3 mm of calcined petroleum coke obtained after screening is crushed to below 3 mm and then mixed with minus 3 mm size fraction previously obtained by screening to achieve the bulk range of 760–800 kg/m$^3$.

(b) The use of calcined petroleum coke at the range of 10–50% by weight, mixed with coke breeze (×3 mm) gives higher strength in terms of point crushing strength and micum indices. The ash content of the product is also increased to the extent which will be helpful to maintain the slag viscosity in the furnace hearth.

(c) The calcined petroleum coke with or without coke breeze is then pre-soaked with 5–10% water by weight of dry solids. Then it is mixed with Asphalt of 80/100 grade used as binder. The proportion of solids; binder is maintained at 93:7 by weight of dry solids. The binder may be asphalt of 80/100 grade having softening point of 45–52° C. or a cut fraction above 300° C. having S.P. 45–52° C. of coal tar obtained from low temperature/medium temperature carbonization of coal.

(d) The mixture is then thoroughly mixed and kneaded in the kneader unit in presence of live steam at a gauge pressure of 6.0 kg/cm$^2$–8.0 kg/cm$^2$ where the temperature of the mixture goes upto 70–90° C.

(e) The hot mixture from the kneader is then fed to a twin paddle mixer to cool down the temperature of mixture at 50–60° C.

(f) The mixture from the mixer as stated in (e) is then fed to twin roll briquetting press through a screw feeder/pan feeder. The mixture is briquetted by twin roll press at a pressure of 200–300 kg/cm$^2$. The green briquettes obtained from the rolls are of shape and of weight between 25 gm to 380 gm depending on the dimension of the briquettes.

(g) The green briquettes are cured in the furnace in batches. The heating of the furnace and the control of the temperature at desired level is done by generating hot flue gas by combustion of coal in a controlled oxidizing atmosphere. The temperature of curing bed is raised by introducing hot flue gas to the briquettes placed in layers in a controlled condition. The final temperature of curing bed is raised to 250–300° C. and the temperature is maintained in that range for about 2.5–5.5 hours depending on dimension of the briquettes.

(h) The cured briquettes are then taken out of the furnace and cooled in the atmosphere.

The following examples are given by way of illustration of the present invention and should not be construed to limit the scope of the present invention.

EXAMPLE—1

Calcined petroleum coke (CPC) was initially screened on 3 mm screen and the oversize of CPC was crushed in Jaw Crusher followed by double roll crusher using 3 mm screen so as to obtain the product passing 10% through 3 mm. The screened and crushed CPC was mixed thoroughly and intimately. CPC (×3 mm) was then mixed with coke breeze (×3 mm) in the ratio of 10:90 by weight. The mix was then pre-soaked with 10.0% water and then mixed with 7.0% asphalt of 80/100 grade by weight. The mix was then conveyed to a kneader-cum-mixer where it was thoroughly kneaded in presence of live steam at a pressure of 6 kg/cm$^2$. The hot kneaded material was then passed a twin paddle type cooler mixer to cool the mix to a temperature of 55–60° C. The cooled material was then continuously fed into a twin roll briquetting press thorough a screw feeder and briquetted at 220–240 kg/cm$^2$ pressure. Finally raw briquettes were cured in a furnace at a temperature of 250±10° C. for 3 hours by generating hot flue gas under controlled conditions.

PROPERTIES OF CURED BRIQUETTES

| | | |
|---|---|---|
| (i) | Wt/briquette, gm | 72.9 |
| (ii) | Bulk density, kg/m$^3$ | 672 |
| (iii) | Point crushing strength, kg | 299 |
| (iv) | Micum Index | |
| | $M_{40}$ | 95.0 |
| | $M_{10}$ | 5.0 |
| (v) | Porosity, % | 40.1 |
| (vi) | Proximate analysis, % | |
| | M | 1.7 |
| | Ash | 19.7 |
| | V.M | 5.1 |
| | F.C | 73.5 |
| (vii) | C.V. Kcal/kg | 5385 |
| (viii) | Reactivity towards $CO_2$ | 142 |
| (ix) | Phosphorus, % | 0.035 |
| (x) | Sulphur, % | 0.72 |
| (xi) | Nitrogen, % | 0.95 |
| (xii) | Carbon, % | 75.70 |
| (xiii) | Hydrogen, % | 0.80 |

EXAMPLE—II

Calcined petroleum coke (CPC) was initially screened on 3 mm screen and the oversize of CPC was crushed in jaw crusher followed by Double Roll crusher using 3 mm screen so as to obtain the product passing 100% through 3 mm. The screened and crushed CPC was mixed thoroughly and intimately. CPC (×3 mm) was then mixed with coke breeze (×3 mm) in the ratio of 20:80 by weight. The mix was the pre-soaked with 10.0% water and then mixed with 7.0% asphalt of 80/100 grade by weight. The mix was then conveyed to a kneader-cum-mixer where it was thoroughly kneaded in presence of live steam at a pressure of 6 kg/cm$^2$ The hot kneaded material was then passed through a twin paddle type cooler mixer to cool the mix to a temp. of 55–60° C. The cooled material was then continuously fed into a twin roll briquetting press through a screw feeder and briquetted at 220–240 kg/cm$^2$ pressure. Finally raw briquettes were cured in a furnace at a temperature of 250±10° C. for 3 hours by generating hot flue gas under controlled conditions.

| PROPERTIES OF CURED BRIQUETTES | | |
|---|---|---|
| (i) | Wt/briquette, gm | 74.1 |
| (ii) | Bulk density, kg/m$^3$ | 672 |
| (iii) | Point crushing strength, kg | 323 |
| (iv) | Micum Index | |
| | $M_{40}$ | 92.5 |
| | $M_{10}$ | 7.5 |
| (v) | Porosity, % | 38.0 |
| (vi) | Proximate analysis, % | |
| | M | 1.6 |
| | Ash | 18.5 |
| | V.M. | 4.5 |
| | F.C. | 75.4 |
| (vii) | C.V, Kcal/kg | 5525 |
| (viii) | Reactivity towards $CO_2$ | 146 |
| (ix) | Phosphorus, % | 0.037 |
| (x) | Sulphur, % | 0.75 |
| (xi) | Nitrogen, % | 1.12 |
| (xii) | Carbon, % | 75.93 |
| (xiii) | Hydrogen, % | 1.01 |

EXAMPLE—III

Calcined petroleum coke (CPC) was initially screened on 3 mm screen and the oversize of CPC was crushed in jaw crusher followed by Double roll crusher using 3 mm screen so as to obtain the product passing 100% through 3 mm. The screened and crushed CPC was mixed thoroughly and intimately. CPC (×3 mm) was then mixed with coke breeze (×3 mm) in the ratio of 30:70 by weight. The mix was then pre-soaked with 10.0% water and then mixed with 7.0% asphalt of 80/100 grade by weight. The mix was then conveyed to a kneader-cum-mixer where it was thoroughly kneaded in presence of live steam at a pressure of 6 kg/cm$^2$ The hot kneaded material was then passed through a twin paddle type cooler mixer to cool the mix to a temp. of 55–60° C. the cooled material was then continuously fed into a twin roll briquetting press through a screw feeder and briquetted at 220–240 kg/cm$^2$ pressure. Finally raw briquettes were cured in a furnace at a temperature of 250±10° C. for 3 hours by generating hot flue gas under controlled conditions.

| PROPERTIES OF CURED BRIQUETTES | | |
|---|---|---|
| (i) | Wt/briquette, gm | 77.0 |
| (ii) | Bulk density, kg/m$^3$ | 640 |
| (iii) | Point crushing strength, kg | 329 |
| (iv) | Micum Index | |
| | $M_{40}$ | 90.00 |
| | $M_{10}$ | 10.0 |
| (v) | Porosity, % | 29.9 |
| (vi) | Proximate analysis, % | |
| | M | 1.3 |
| | Ash | 15.4 |
| | V.M | 4.5 |
| | F.C | 78.8 |
| (vii) | C.V. Kcal/kg | 5895 |
| (viii) | Reactivity towards $CO_2$ | 154 |
| (ix) | Phosphorus, % | 0.026 |
| (x) | Sulphur, % | 0.74 |
| (xi) | Nitrogen, % | 0.94 |

-continued

| PROPERTIES OF CURED BRIQUETTES | | |
|---|---|---|
| (xii) | Carbon, % | 79.79 |
| (xiii) | Hydrogen, % | 1.08 |

EXAMPLE—IV

Calcined petroleum coke (CPC) was initially screened on 3 mm screen and the oversize of CPC was crushed in jaw crusher followed by Double roll crusher using 3 mm screen so as to obtain the product passing 100% through 3 mm. The screened and crushed CPC was mixed thoroughly and intimately. CPC (×3 mm) was then mixed with coke breeze (×3 mm) in the ratio of 40:60 by weight. The mix was the pre-soaked with 10% water and then mixed with 7.0% asphalt of 80/100 grade by weight. The mix was then conveyed to a kneader-cum-mixer where it was thoroughly kneaded in the presence of live steam at a pressure of 6 kg/cm$^2$. The hot kneaded material was then passed through a twin paddle type cooler mixer to cool the mix to a temp. of 55–60° C. The cooled material was then continuously fed into a twin roll briquetting press through a screw feeder and briquetted at 220–240 kg/cm$^2$ pressure. Finally raw briquettes were cured in a furnace at a temperature of 250±10° C. for 3 hours by generating hot flue gas under controlled conditions.

| PROPERTIES OF CURED BRIQUETTES | | |
|---|---|---|
| (i) | Wt/briquette, gm | 80.00 |
| (ii) | Bulk density, kg/m$^3$ | 672 |
| (iii) | Point crushing strength, kg | 385 |
| (iv) | Micum Index | |
| | $M_{40}$ | 91.2 |
| | $M_{10}$ | 8.8 |
| (v) | Porosity, % | 31.6 |
| (vi) | Proximate analysis, % | |
| | M | 0.6 |
| | Ash | 14.4 |
| | V.M. | 4.5 |
| | F.C. | 80.5 |
| (vii) | C.V, Kcal/kg | 6710 |
| (viii) | Reactivity towards $CO_2$ | 156 |
| (ix) | Phosphourous, % | 0.017 |
| (x) | Sulphur, % | 0.75 |
| (xi) | Nitrogen, % | 0.68 |
| (xii) | Carbon, % | 81.49 |
| (xiii) | Hydrogen, % | 0.80 |

EXAMPLE V

Calcined petroleum coke (CPC) was initially screened on 3 mm screen and the oversize of CPC was crushed in jaw crusher followed by Double roll crusher using 3 mm screen so as to obtain the product passing 100% through 3 mm. The screened and crushed CPC was mixed thoroughly and intimately. CPC (×3 mm) was then mixed with coke breeze (×3 mm) in the ratio of 50:50 by weight. The mix was then pre-soaked with 10% water and then mixed with 7.0% asphalt of 80/100 grade by weight, The mix was then conveyed to a kneader-cum-mixer where it was thoroughly kneaded in presence of live steam at a pressure of 6 kg/cm$^2$. The hot kneaded material was then passed through a twin paddle type cooler mixer to cool the mix to a temp. of 55–60° C. The cooled material was then continuously fed into a twin roll briquetting press through a screw feeder and briquetted at 220–240 kg/cm$^2$ pressure. Finally raw briquettes were cured in a furnace at a temperature of 250±10° C. for 3 hours by generating hot flue gas under controlled conditions.

PROPERTIES OF CURED BRIQUETTES

| | | |
|---|---|---|
| (i) | Wt/briquette, gm | 77.7 |
| (ii) | Bulk density, kg/m$^3$ | 688 |
| (iii) | Point crushing strength, kg | 425 |
| (iv) | Micum Index | |
| | $M_{40}$ | 92.5 |
| | $M_{10}$ | 7.5 |
| (v) | Porosity, % | 37.0 |
| (vi) | Proximate analysis, % | |
| | M | 1.1 |
| | Ash | 12.3 |
| | V.M | 4.8 |
| | F.C. | 81.8 |
| (vii) | C.V., Kcal/kg | 6505 |
| (viii) | Reactivity towards $CO_2$ | 138 |
| (ix) | Phosphorus, % | 0.010 |
| (x) | Sulphur, % | 0.86 |
| (xi) | Nitrogen, % | 0.80 |
| (xii) | Carbon, % | 83.08 |
| (xiii) | Hydrogen, % | 1.03 |

EXAMPLE—VI

Calcined petroleum coke (CPC) was initially screened on 3 mm screen and the oversize of CPC was crushed in Jaw Crusher followed by double roll crusher using 3 mm screen so as to obtain the product passing 100% through 3 mm. The screened and crushed CPC was mixed thoroughly and intimately. The mix was then presoaked with 10% water and then mixed with 7.0% asphalt of 80/100 grade by weight. The mix was then conveyed to a kneader-cum-mixer where it was thoroughly kneaded material was then passed through a twin paddle type cooler mixer to cool the mix to a temperature of 55–60° C. The cooled material was then continuously fed into a twin roll briquetting press through a screw feeder and briquetted at 220–240 kg/cm$^2$ pressure. Finally raw briquettes were cured in a furnace at a temperature of 250±10° C. for 3 hours by generating hot flue gas under controlled conditions.

The main advantages of the present invention are

1. The process is simple and less expensive. The process consists of calcined petroleum coke either as such or by weight of dry solids, mixing with organic binder in presence of live steam and then briquetted by twin roll press at a pressure of 200–300 kg/cm$^2$. The green briquettes are then cured in a furnace at a temperature of 250–300° C. for a period of 2.5–5.5 hours.

2. The product obtained from the process is hard, shaped and sized, smokeless, water and weather resistant fuel from calcined petroleum coke produced in oil refineries. The product obtained by utilizing all the calcined petroleum coke is of very low ash, low phosphorus content and can be suitably shaped and sized as per requirement in the Ferro-Chrome, Ferro-Silicon, Ferro-manganese and allied industries.

3 The process uses Asphalt (80/100 grade) as binder which is readily available in the marker and thus minimizes the cost towards binder preparations.

4. The process is relatively cheap since a lower percentage of binder is used and the crushing is required only for a fraction of calcined petroleum coke and coke breeze.

5 The process does not require any carbonization step to make the product smokeless.

6. The process is relatively less expensive for the production of low ash, low phosphorus, high calorific value content product to be used as a fuel for industrial/metallurgical purposes in place of conventional coke in the hearth. Capital investment required to set up a plant for a 40 tpd capacity will well remain within the limit market for Small Scale Industrial Sector.

We claim:

1. A process for the production of low ash fuel using calcined petroleum coke which comprises crushing and screening calcined petroleum coke having a particle size below 3 mm mixing the crushed and screened materials to achieve a bulk density in the range 760 to 800 kg/m$^3$, optionally mixing the resultant calcined petroleum coke with coke breeze to produce a mix containing at least 10% calcined petroleum coke, presoaking the petroleum coke particles or the mix thereof with coke breeze with 5–10% water, mixing with binder followed by kneading in the presence of live steam, then briquetting and curing the raw briquettes in a furnace in a controlled oxidizing atmosphere to obtain the low ash fuel.

2. A process as claimed in claim 1, wherein Asphalt or processed low temperature tar is used as binder.

3. A process as claimed in claim 2 wherein the binder is used is in the range of 6 to 7%.

4. A process as claimed in claims 1 wherein the curing of briquettes is effected at a temperature in the range of 250 to 300° C. for a period in the range of 2.5 to 5.5 hours.

5. A process as claimed in claim 1 wherein the process is carried out in the absence of the step of carbonisation.

* * * * *